US005392985A

United States Patent [19]

Smith et al.

[11] Patent Number: 5,392,985

[45] Date of Patent: Feb. 28, 1995

[54] CONTAINER FOR SHIPPING STORING AND DISPLAYING ARTICLES

[76] Inventors: Ronnie Smith, 1606 W. North St., P.O. Box 1834, Vidalia, Ga. 30474; A. L. Hartley, 141 Nelson Ave., Lyons, Ga. 30436

[21] Appl. No.: 260,681

[22] Filed: Jun. 16, 1994

Related U.S. Application Data

[63] Continuation of Ser. No. 93,557, Jul. 19, 1993, abandoned.

[51] Int. Cl.[6] ..... B65D 5/66

[52] U.S. Cl. ..... 229/125; 206/45.29; 229/143; 229/149; 229/177

[58] Field of Search ..... 229/125, 143, 149, 177; 206/45.13, 45.21, 45.29

[56] References Cited

U.S. PATENT DOCUMENTS

| | | | |
|---|---|---|---|
| 1,098,245 | 5/1914 | Gaskill | 229/149 |
| 1,411,678 | 4/1922 | Walker | 206/45.29 |
| 1,525,360 | 2/1925 | Blandford | 229/149 |
| 1,558,494 | 10/1925 | Newton | 206/45.29 |
| 1,714,542 | 5/1929 | Bergstein | 206/45.29 |
| 1,813,298 | 7/1931 | Klin | 229/149 |
| 2,630,914 | 3/1953 | Bekoff | 206/45.29 |
| 3,889,868 | 6/1975 | Bruckner et al. | 229/125 |
| 4,164,314 | 8/1979 | Edgar | 229/125 |
| 4,600,142 | 7/1986 | Quaintance | 229/143 |
| 4,648,549 | 3/1987 | Trutna | 229/143 |

*Primary Examiner*—Gary E. Elkins

*Attorney, Agent, or Firm*—Michael Drew

[57] ABSTRACT

A box-like container (10) is formed from a scored blank (12) which has a base panel (20) which serves as the bottom of the box, base side panels (22, 24) connected to the sides of the base panel (20), a rear panel (40) connected to the rear edge of the base panel (20), rear side panels (42, 44) connected to the sides of the rear panel (40), a primary top panel (50) connected to the rear panel (40), support flaps (52, 54) connected to the sides of the primary top panel (50), a secondary top panel (60) connected to the primary top panel (50), securement flaps (62, 64) forming tabs (66, 68) at each end, connected to the sides of the secondary top panel (60), a front panel (70) connected to the front edge of the base panel (20), front side panels (72, 74) connected to each side of the front panel (70), a canopy/auxiliary top panel (80) connected to the front panel (70), and support flaps (82, 84) connected to each side of the canopy/auxiliary top panel (80). Each side panel (22, 24, 42, 44, 72, 74) is provided with a respective handle cut-out (34, 47, 77). The side panels (22, 24, 42, 44, 72, 74) have interlocking structures. The primary (50) and secondary (60) top panels may be secured to the erected box by means of a tab (66, 68) and slot (36) interlocking structure. The primary (50) and secondary (60) top panels also may be folded and interconnected to form a display tray (90) when the box is laid flat on the rear panel (40). In the display mode, a canopy (92) can be erected from the canopy panel (80) and support flaps (82, 84), and interlocked with the display tray (90).

26 Claims, 4 Drawing Sheets

CONTAINER FOR SHIPPING STORING AND DISPLAYING ARTICLES

This application is a continuation of application Ser. No. 08/093,557, filed Jul. 19, 1993, now abandoned.

TECHNICAL FIELD OF THE INVENTION

The present invention relates to containers for holding articles, and more particularly to a container which may be used to store and ship articles, and also converted to a display for the enclosed articles

BACKGROUND OF THE INVENTION

It is important in the production, distribution and sale of perishable and non-perishable articles that the articles be safely and conveniently stored for transport after production and, then, also safely and conveniently, shipped for sale. Safe and convenient storage and shipping is particularly a problem if heavy, perishable items must be placed in containers that are stacked upon each other. The problem is that container must be strong enough to withstand the weight of other containers that are placed upon it. If the container is made of paperboard, the strength factor is even more important because paperboard material in general fatigues easily. Futher, if the environment in which the paperboard container is shipped or stored is refrigerated, the moisture present in a refrigerated environment is likely to be absorbed by and weaken the container, thereby exacerbating the problems caused by stacking. An additional concern is that once the articles reach a retail destination, they must normally be displayed for sale. It can be appreciated that it would be useful to have a single durable container in which articles may be safely and conveniently stored, transported and displayed.

SUMMARY OF THE INVENTION

It is an object of the invention to provide a container in which articles may be safely and conveniently stored, shipped and displayed.

It is a further object of the invention to provide a container in which articles may be safely and conveniently stored, shipped and displayed, which is formed from a blank.

In the present invention, a box-like container is formed from a scored blank which has a base panel which serves as the bottom of the box, base side panels connected to the sides of the base panel, a rear panel connected to the rear edge of the base panel, rear side panels connected to the sides of the rear panel, a primary top panel connected to the rear panel, support flaps connected to the sides of the primary top panel, a secondary top panel connected to the primary top panel, securement flaps forming tabs at each end connected to the sides of the secondary top panel, a front panel connected to the front edge of the base panel, front side panels connected to each side of the front panel, a canopy panel connected to the front panel, and support flaps connected to each side of the canopy panel. Each side panel is provided with a handle cutout. The side panels have interlocking structures. The primary and secondary top panels may be secured to the erected box by means of a tab and slot interlocking structure. The primary and secondary top panels also may be folded and interconnected to form a display tray when the box is laid flat on the rear panel. In the display mode, a canopy can be erected from the canopy panel and support flaps, and interlocked with the display tray.

Other aspects, objects, features, and advantages of the present invention will become apparent to those skilled in the art upon reading the detailed description of preferred embodiments.

DETAILED DESCRIPTION OF PREFERRED EMBODIMENTS OF THE INVENTION

Figure 1:
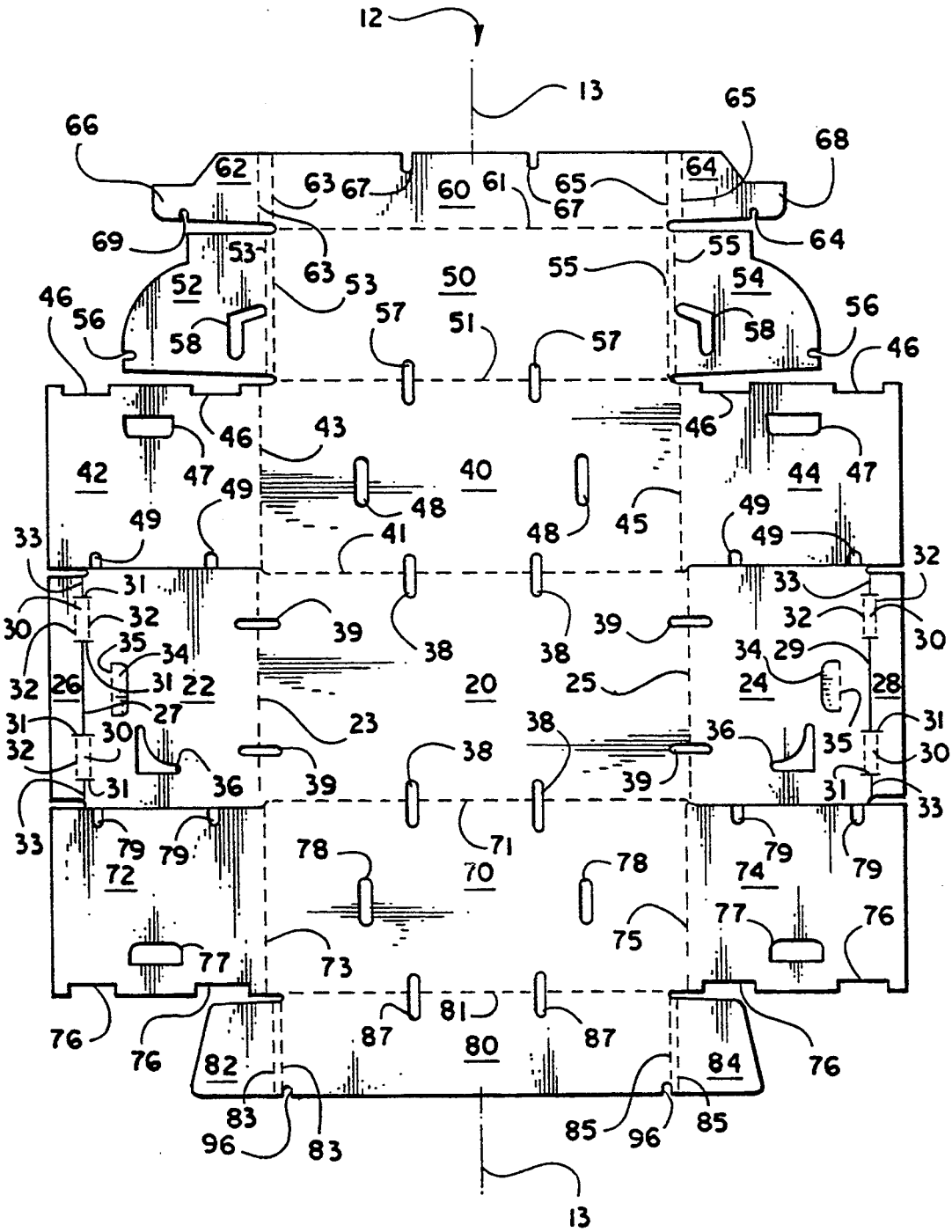
FIG. 1 is a plan view of a blank for forming a container for storing, shipping and displaying articles according to a preferred embodiment of the invention.

While the specification concludes with claims particularly pointing out and distinctly claiming the subject matter which is regarded as the present invention, the invention will now be described with reference to the following description of embodiments taken in conjunction with the accompanying drawings. Throughout the drawings, the same reference numerals are used to denote like features.

Figure 2:
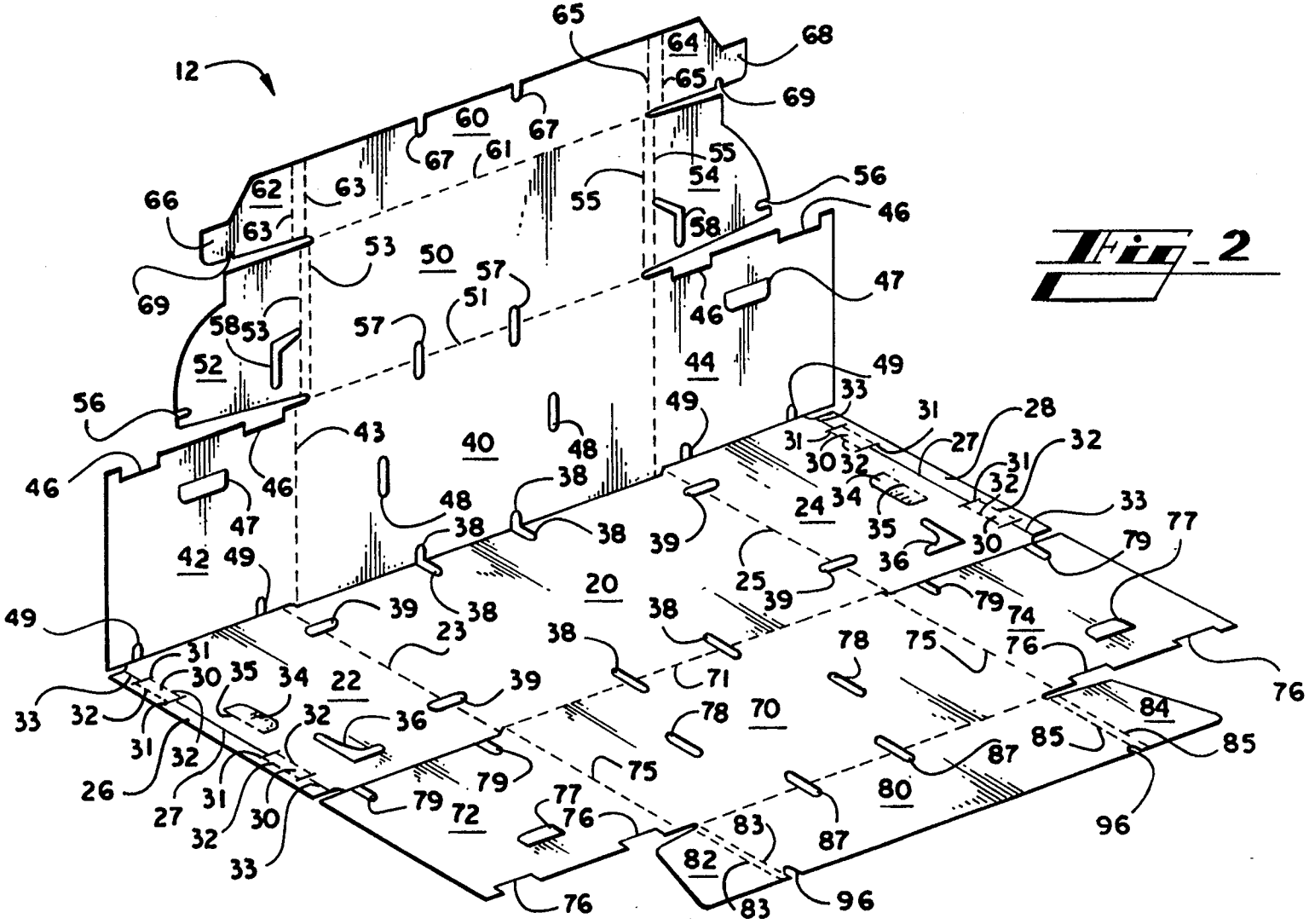
FIG. 2 is an isometric illustration of a partially-erected container formed from the blank of FIG. 1.

A preferred embodiment of the invention will be discussed by referencing the illustrations of FIGS. 1 through 5 which respectively start with a blank 12 for forming a container for storing, shipping, and displaying articles 10 and proceed through the formation of the erected container 10 and its transformation into a display. Referring first to FIG. 1, therein is illustrated a preferred embodiment of a blank 12 for forming a container for storing, shipping, and displaying articles 10. For the initial portion of this discussion, FIGS. 1 and 2 may be referred to simultaneously because both drawings illustrate all of the same features of the invention. While FIG. 1 is essentially the two-dimensional blank, FIG. 2 is the same blank but partially erected into container 10 form by placing the rear panel of the container 10 into an upright position.

The blank 12 is scored through the use of so-called "fold lines" or "crease lines" which together with various cuts and punched-out portions define all of the elements for forming the container 10. Throughout the discussion, for convenience and clarity, the elements will be referred to by names which relate to their ultimate function in the erected container 10. The blank 12 of the preferred embodiment is symmetrical in that the blank 12 consists of identical left and right sides about a lengthwise centerline 13 of the blank. Each side contains identical elements° In this discussion, the container 10 will sometimes also be referred to as a box 10 because in the preferred embodiment the container is essentially a box. In the blank 12, the central element is a base panel 20. The base panel 20 ultimately becomes the bottom of the box 10. Side panels 22, 24 extend from the base panel 20 along respective fold lines 23, 25. What ultimately will be utilized as retaining flaps 26, 28 are separated from the base side panels 22, 24 by extended slits 27, 29 and end slits 33, and connected to the base side panels 22, 24 by webs 30. A web 30 is formed at the end of each retaining slit 27, 29. Each web 30 will become a part of a clamp-like mechanism for locking together the side walls of the erected container 10. Each web 30 is formed by parallel slits 31 cut perpendicular to an extended slit 27, 29, with a pair of parallel fold lines 32 extending between the pair of slits 31. Each end slit 33 for separating the end of each side panel 22, 24 from its respective retaining flap 26, 28 extends from the outermost web slits 31 to the edges of the side panels 22, 24 and retaining flaps 26, 28. A portion of each side panel 22, 24 is punched out and scored to form a push-through type of handle 34. Each handle 34 is attached to the side panel 22, 24 along a fold line 35. A slot 36 which ultimately serves as a part of the structure which locks the top of the container 10 over the top opening of the container 10 is formed in each side panel 22, 24. The slot 36 in the preferred embodiment is essentially L-shaped with a curved (or arcuate) inner perimeter. Vent openings (or venting apertures) 38, 39 are formed along the fold lines 41, 71, 23, 25 which define the perimeter of the base panel 20. In the preferred embodiment, these apertures 38, 29 extend into the base panel 20 and panels 22, 24, 40, 70 adjoining the base.

A rear panel 40 extends from the base panel 20 along fold line 41. The rear panel 40 ultimately becomes the rear wall of the erected container 40. Panels extend from each side of the rear panel. Because these panels will ultimately become side walls of the erected container, for convenience and clarity of understanding, they will be referred to as rear side panels 42, 44. Rear side panels 42, 44 extend from the rear panel 40 along respective fold lines 43, 44. The distance from the bottom edge of the rear panel (that is, at fold line 41) to the top edge (that is, along fold line 51) becomes the depth of the erected container 10 and, thus, corresponds to the height of the side panels 22, 24 (that is, the distance between fold lines 23, 25 and respective fold lines 27, 29) that form the side walls of the erected container. For convenience, this "distance" will be referred to as the height of the rear panel 40. Similarly, the distance from the bottom edges of the rear side panels 42, 44 (bottom being the edge parallel or coincident with fold line 41) to the top edges thereof (that is, the edges being parallel or coincident with fold line 51) also correspond to the height of the side panels 22 24. For convenience, this "distance" will be referred to as the height of the rear side panels 42, 44. When the container 10 is erected from the blank 12, the base side panels 22, 24 are placed face to face with respective rear side panels 42, 44 to form the side walls for the erected container 10. The "distances" and corresponding "heights" described above are essentially the same and define the depth of the erected box 10. Notches 46 are formed along the top edge of each rear side panel 42, 44 to receive a web 30 When the side panels 22, 42 and 24, 44 are aligned face to face to form the side walls of the erected container 10. A slot 47 of D-shaped configuration is formed in each rear side panel 42, 44 to coincide with the handle 34 formed in each base side panel 22, 24 when the container is erected. Venting apertures 48 are formed in the rear panel 40. Venting apertures 49 are formed along the bottom edge of each rear side panel 42, 44 to correspond and align with the venting apertures 39 formed along the bottom edge (as defined by fold lines 23, 25) of each base side panel 22, 24. As previously mentioned, the vent openings/venting apertures 38 along fold line 41 extend into the rear panel 40.

In the erected container, or box, 10, the top of the container is connected by an integral hinge to the top edge of the rear panel 40. The elements of the preferred embodiment which serve as the top for the erected container 10 also serve as a tray for the container 10 when the container 10 is utilized in the display mode. For this reason, the top is divided into two panels 50, 60 referred to respectively as primary and secondary top panels. The primary top panel 50 is connected to the rear panel 40 along fold line 51. Flaps, which for convenience will be referred to as tray support flaps, 52, 54 extend from each side of the primary top panel along respective double fold lines 53, 55. A notch 56 is formed in each support flap 52, 54 for interconnecting the tray 90 and canopy 92 formed when the container 10 is used in the display mode. A slot 58 is formed in each support flap 52, 54 for serving as a part of the locking mechanism for forming the tray 90 of the container. The slot 58 is essentially V-shaped (or boomerang-shaped). Venting apertures 57 are formed along fold line 51 and extend into the rear panel 40 and primary top panel 50.

A secondary top panel 60 extends from the primary top panel 50 along fold line 61. Flaps 62, 64 used to help lock the secondary top panel 60 to either the base side panels 22, 24 or the support flaps 42, 44 (to form the tray 90) are for convenience referred to as locking flaps 62, 64. The locking flaps 62, 64 are connected to the secondary top panel 60 along respective double fold lines 63, 65. Each locking flap 62, 64 has at its respective end a tab 66, 68 for interconnecting with either a slot 36 on a base side panel 22, 24 or a slot 58 on a support flap 52, 54. A notch 69 in each tab 66, 68 forms a part of the locking structure for the top or the display tray, which will be described in detail later. Venting apertures (vent openings) 67 are formed along the free edge of the secondary panel 60. These apertures/openings are positioned to correspond and align with similar openings (described below) in an auxiliary top panel 80 of the blank 12 when the container 10 is erected.

The front panel 70 extends from the base panel 20 along fold line 71. The front panel 70 ultimately becomes the front wall of the erected container 10. The front panel 70 and its side panels 72, 74 are mirror reflections of and are identical to the rear panel 40 and its side panels 42, 44. The front side panels 72, 74 are connected to the front panel 70 along respective fold lines 73, 75. When the container 10 is erected from the blank 12, the rear side panels 42, 44 are placed face to face with respective front side panels 72, 74 to help form the side walls for the erected container 10. The positioning of the left and right rear and front side panels 42 and 72 & 44 and 74 with respect to one another in the erected container 10 is interchangeable. That is, the "sandwich" formed by each set of side panels 22, 42, 72 and 24, 44, 74 may have either the side panels associated with the rear panel 40 or the side panels associated with the front panel 70 as either the innermost or middle "layer of the sandwich." The front side panels 72, 74 are identical to the rear side panels 42, 44, and, thus, likewise, the height of the front side panels 72, 74 corresponds to the height of the base side panels 22, 24. Notches 76 are formed along the top edge of each front side panel 72, 74 to receive the web 30 when the base side panels 22, 24 are aligned with the rear and front side panels 42, 44, 72, 74 to form the side walls of the erected container 10. A slot 77 of D-shaped configuration is formed in each front side panel 72, 74 to coincide with the handle 34 formed in each base side panel 22, 24 when the container is erected. The handle slots 77 of the front side panels 72, 74 and the handle slots 47 of the rear side panels 42, 44 are positioned to coincide with one another when the side panels 22, 24, and 42, 44, and 72, 74 are respectively sandwiched together to form the respective side walls of the erected container 10. Venting apertures 78 are formed in the front panel 40. Venting apertures 79 are formed along the bottom edge of each front side panel 72, 74 to correspond and align with the venting apertures 39 formed along the bottom edge (as defined by fold lines 23, 25) of each respective base side panel 22, 24 when the container 10 is erected from the blank 12. As previously mentioned, the vent openings/venting apertures 38 along fold line 71 extend into the front panel 70..

A panel 80 which extends from the front panel 70 along fold line 81 serves a dual purpose, and for that reason is referred to as a canopy/auxiliary-top panel 80. As will be seen in several of the illustrations and the discussion which follows, the canopy/auxiliary-top panel 80 serves as an aid to the primary and secondary top panels 50, 60 to cover the open top of the container 10 formed from the erected blank 12. When the container 10 is used in the display mode, as will be discussed below, the canopy/auxiliary-top panel 80 serves as a canopy for the display container. Canopy support flaps 82, 84 are connected to the canopy/auxiliary-top panel 80 along respective double fold lines 83, 85. Notches 96 on the free edge of the canopy/auxiliary top panel 80 are positioned to interlock with the notches 56 in the tray support panels 52, 54 when the erected container 10 formed from the blank 12 is used in the display mode.

Figure 3:
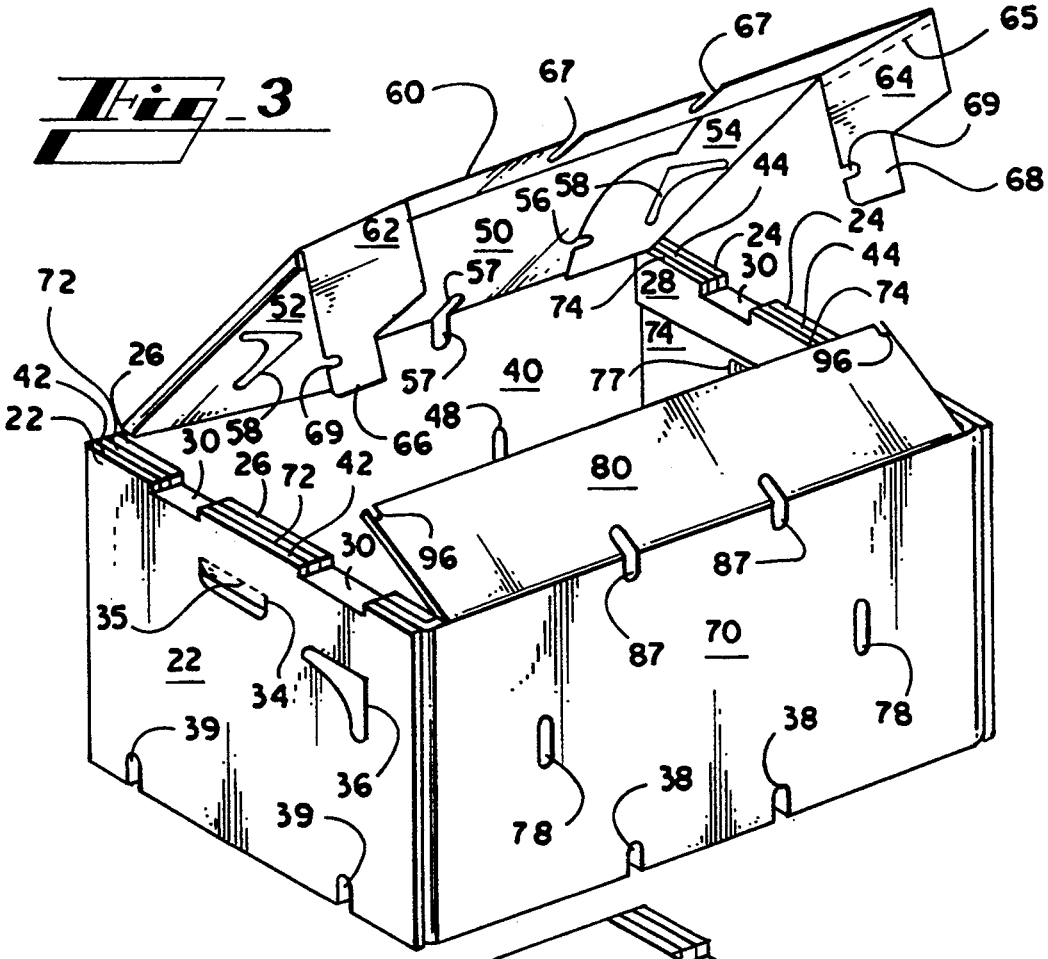
FIG. 3 is an isometric illustration of a fully-erected container formed from the blank of FIG. 1, with the top partially open.

Referring now to FIG. 3, therein is illustrated a fully-erected container 10 which has been formed from the blank 12. As previously mentioned, the front panel 70 forms the front wall of the container 10 while the rear panel 40 forms the rear wall. The manner in which each set of three side panels form each side wall is clearly shown. For each side wall, the base side panel 22, 24 serves as the outer layer of the sandwich. Although the middle and interior layers of the sandwiched wall may be interchanged, in this depiction of the preferred embodiment each rear side panel 42, 44 is the middle wall and each front side panel 72, 74 is the interior wall for each respective side. The mechanism which locks each set of three panels together is also clearly shown. For each wall, each web 30 acts as a hinge between a retaining flap 26, 28 and a respective base side panel 22, 24. Each base side panel 22, 24, its pair of webs 30, and its associated retaining flap 26, 28 essentially form an inverted U-shaped clamp for holding together the respective pair of a rear 42, 44 and front 72, 74 side panels. When the respective base side panels 22, 24 and retaining flaps 26, 28 are folded about the pair webs 30, the configuration of the base side panels 22, 24 become identical to the configuration of the front and rear side panels 42, 44, 72, 74. The webs 30 fit perpendicularly across the slots 46, 76 of the rear and front side panels 42, 44, 72, 74. The length and width of the web 30 correspond to the width of the notches 46, 76 and the total thickness of the pair of rear and front side panels 42 and 72 & 44 and 74. Each pair of rear and front side panels 42 and 72 & 44 and 74 fit within the space between each respective base side panel 22, 24 and retaining flap 26, 28. When the container 10 is used in the storage and shipping mode, the primary and secondary top panels 50, 60 serve as a top to close the container 10. The canopy/auxiliary-top panel 80 may rest under the secondary panel 60 to completely cover the top portion of the front of the container 10. The tray support flaps 52, 54 of the primary top panel and the canopy support flaps 82, 84 of the canopy/auxiliary-top panel 80 may be folded under and out of the way into a face to face position with the respective primary top panel 50 and canopy/auxiliary-top panel 80. The double fold lines 63, 65 of the tray support flaps 52, 54 and the double fold lines 83, 85 of the canopy support flaps 82, 84 enable the flaps to be completely folded under. If the support flaps 52, 54 are not completely folded under when the top is closed, it also possible to interlock the notches 96 with the area between the double fold lines 53, 55 at the joinder of the primary and secondary top panels 50, 60 to lock the container top and canopy/auxiliary top panel 80 together. The vent openings (venting apertures) 38, 39 extending from the base panel 20 into the side 22 and front 70 panels can also be seen in this view.

Figure 4:
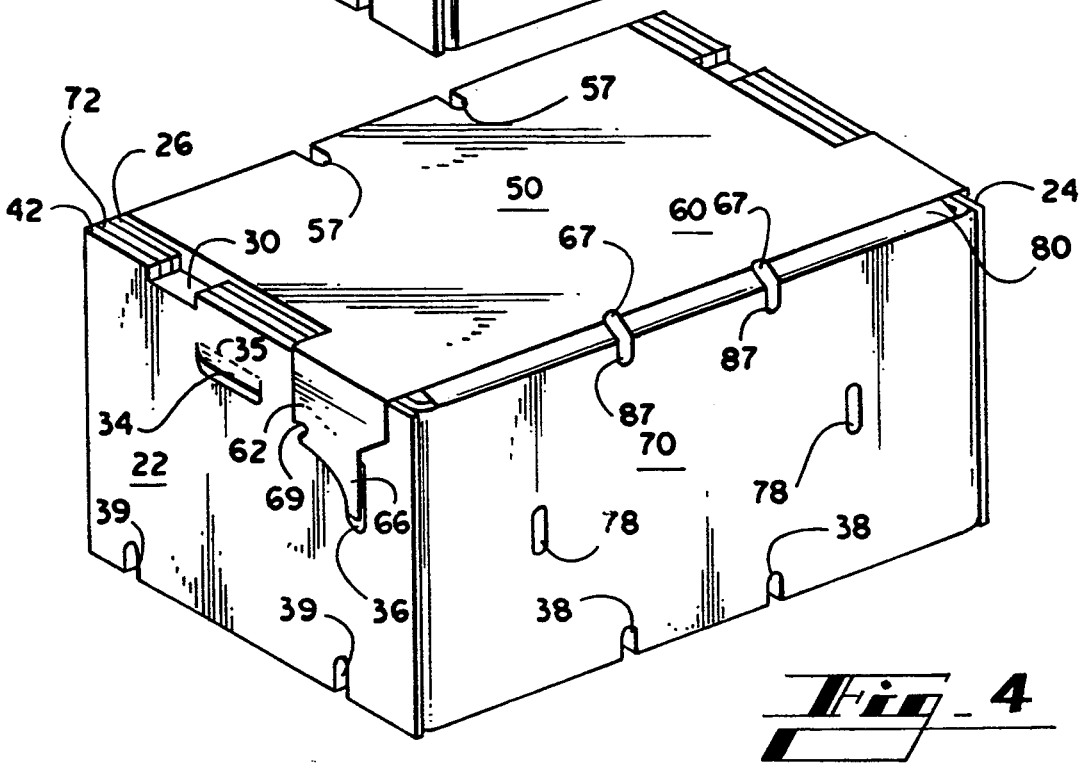
FIG. 4 is an isometric illustration of the container of FIG. 3 with the top closed and locked.

Referring now to FIG. 4, the same features illustrated in FIG. 3 are shown with the top of the container 10 completely closed and locked in place. Referring now simultaneously to FIGS. 3 and 4, the tab 66 at the end of the locking flap 62 is inserted in the slot 36 of the base side panel 22 to secure one side of the secondary top panel 60 to the box. Likewise, though not able to be seen from the perspective of this view, the locking tab 68 on the other locking flap 64 is fitted through the slot 36 on the base side panel 24 to secure that side of the secondary top panel 60 to the container 10. The pressure placed upon the outermost side panel 22 by the face to face contact of that side panel 22 with the adjacent rear side panel 42 helps hold the locking tab 66 in place. The tab 66 is additionally held in place by the interface of the notch 69 with the edge or corner of the L-shaped slot 36. The curved inner perimeter of the L-shaped slot 36 promotes smoother insertion of the tab 66. As previously mentioned, the same interaction of identical features is achieved on the opposite side of the container 10. With the top closed, the alignment of the venting notches 67 along the free edge of the secondary top panel 60 with the vent openings (venting apertures) 87 in the canopy/auxiliary top panel 80 is clearly shown. This view further illustrates the manner in which the canopy/auxiliary top panel 80 acts to cover the front portion of the container 10.

Figure 5:
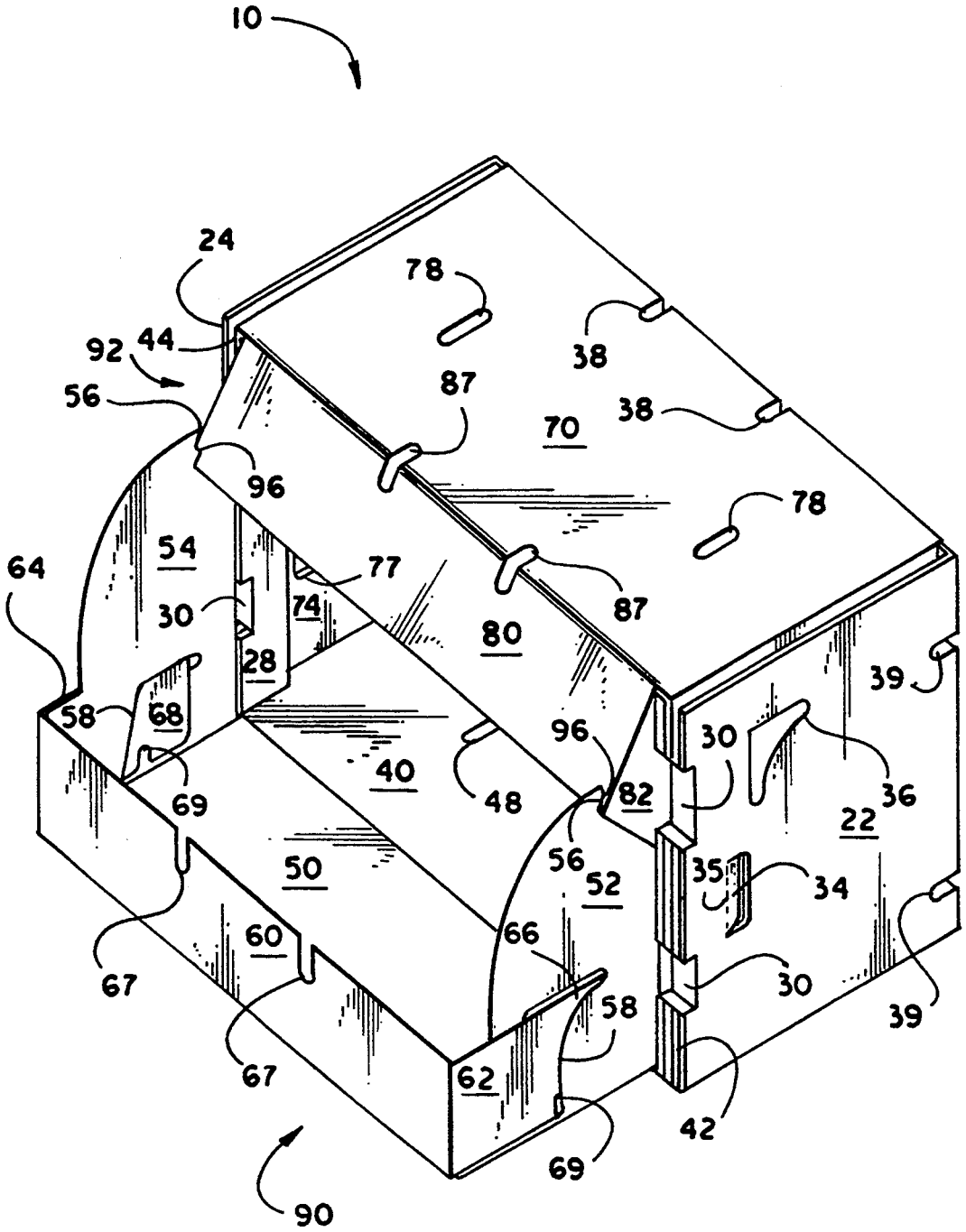
FIG. 5 is an isometric illustration of the container previously illustrated in FIGS. 1–4, in a display configuration.

Referring now to FIG. 5, the container 10 is shown in a display mode. In the display mode, the container is placed upon its rear, that is, the rear panel 40 now serves as the bottom. The base panel 20 (not seen in this view) becomes the rear wall and the front panel 70 becomes the top wall. A tray 90 is formed at what is now the front of the container 10 by inserting the locking tabs 66, 68 in the V-shaped notches 58 of the respective tray support flaps 52, 54. The notches 69 of the locking flaps 62, 64 engage the slots 58 to secure the interconnection. The primary top panel 50 now serves as the bottom of the display tray 90 and the secondary top panel 60 serves as the front edge of the display tray 90. A canopy 92 is formed from the canopy/auxiliary top panel 80. The canopy 92 is held in place by interlocking notches 96 along the front edge of the canopy-/auxiliary top panel 80 with the notches 56 in the tray support flaps 52, 54. The canopy support flaps 82, 84 serve as the sides of the canopy 80.

The blank 12 and container 10 may be formed from any of several types of durable, foldable materials. For example, corrugated paperboard may be used. Corrugated paperboard is particularly suitable because it is durable, relatively inexpensive and easily die stamped and formed into a container. The blank 12 is easily constructed for a sheet of desired material using a die stamping process. The cost of the die for such a process may be minimized by utilizing a die that forms one-half of the blank 12 because the blank 12 is symmetrical about the centerline 13, as discussed above. The exterior of the blank 12 and container 10 may be inscribed with decorative, informational and/or promotional material as desired to enhance the use of the container 10.

The vent (or venting) openings (apertures) 38, 39, 48, 49, 57, 67, 79, 87 enable air to circulate through the container 10. It is important that air be allowed to flow through the container 10 when certain types of articles are held in the container 10. This is particularly so in the case of many perishable items. For example, perishable goods such as onions are better maintained in an environment where air is permitted to flow around and through the contained articles.

The "sandwiched," three-layer side walls provide exceptional strength and durability for the container 10 in either the storage/shipping mode or the display mode. When a paperboard container is used, the extra strength is particularly useful in the shipping and storage of heavy food items, such as onions, which are stored and transported in refrigerated areas. The refrigeration process introduces moisture into the refrigerated area. In turn, some moisture is absorbed by paperboard containers. Moisture weakens paperboard containers. The extra strength provided by the three-layer side walls enables the container 10 to be loaded and stacked one on another in a refrigerated environment.

The container 10 enables articles are able to be stored, shipped and displayed in a single durable container. The container can be quickly and easily assembled from the blank 12, then loaded with articles. The top of the container 10 can be quickly and easily locked in place as described above. Upon arrival at a retail destination,the top may be quickly opened and the display tray 90 formed as described above. The container 10 may then be easily rotated rearward to rest upon the rear panel 40. The container 10 is then in a display position which allows articles to freely flow into the tray 90. The canopy 92 is essentially automatically in place when the container 10 is set upon its rear. In addition to being a decorative feature the canopy will help restrict the flow of articles onto the tray because flowing articles must pass under the canopy 92. The tray 90 and canopy 92 may be interlocked as described above to provide an attractive, sturdy, store-ready display. Because the erected container 10 is sturdy, easy to assemble, and ventilated, it is particularly suitable for storage, shipping, and display of perishable consumer items such as world-famous Vidalia onions.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. A blank for forming a container for storing, transporting and displaying articles comprising:

a base panel having a front edge, a rear edge, and opposing side edges;

a pair of opposing base side panels each foldably joined to said base panel at a respective said opposing side edge of said base panel, having a first exterior edge distal said side edge of said base panel;

a rear panel foldably joined to said[base panel at said rear edge of said base panel, having a bottom edge coincident with said rear edge of said base panel, a top edge, and opposing side edges;

a pair of opposing rear side panels each foldably joined to said rear panel at a respective said opposing side edge of said rear panel adjacent a respective said base side panel, having a top edge substantially collinear with said top edge of said rear panel, a bottom edge substantially collinear with said bottom edge of said rear panel, a second exterior edge distal a respective said side edge of said rear panel and a configuration corresponding to a configuration of said base side panel;

wherein a first distance between said top edge of said rear panel and said bottom edge of said rear side panel is generally equal to a second distance between said first exterior edge of said base side panel and said side edge of said base panel; and wherein said bottom edge of said rear side panel and said top edge of said rear side panel correspond respectively to said side edge of said base panel and said first exterior edge of said base side panel; and a primary top panel foldably joined to said rear panel at said top edge of said rear panel, having a rear edge coincident with said top edge of said rear panel, a front edge, and opposing side edges;

a pair of opposing tray support flaps foldably joined to said primary top panel at respective said side edges thereof;

a secondary top panel foldably joined to said primary top panel at said front edge of said primary top panel, having a rear edge coincident with said front edge of said primary top panel, a front edge, and opposing side edges;

a pair of locking flaps foldably joined to said secondary top panel at respective said side edges thereof;

a front panel foldably joined to said base panel at said front edge of said base panel, having a bottom edge coincident with said front edge of said base panel, a top edge, and opposing side edges;

a pair of opposing front side panels each foldably joined to said front panel at respective said opposing side edge of said front panel adjacent a respective said base side panel, having a top edge substantially collinear with said top edge of said front panel, a bottom edge substantially collinear with said bottom edge of said front panel, a third exterior edge distal said side edge of said front panel and a having configuration corresponding to a configuration of said respective said base side panel means for securing respective said base side panels, said rear side panels and said front side panels in face to face relationship when the container is erected;

wherein a third distance between said top edge of said front panel and said bottom edge of said front panel is generally equal to said second distance between said first exterior edge of said base side panel and said side edge of said base panel; and wherein said bottom edge of said front side panel and said top edge of said front side panel correspond respectively to said side edge of said base panel and said first exterior edge of said base side panel; and an auxiliary top panel foldably joined to said front panel at said top edge of said front panel, having a front edge coincident with said top edge of said front panel, a rear edge, and opposing side edges;

a pair of opposing canopy support flaps foldably joined to said auxiliary top panel at respective said side edges thereof; means for releasably securing said primary top panel and said secondary top panel in perpendicular relation to one another when folded; and means for releasably securing said secondary top panel with said auxiliary top panel so as to cover the container when folded.

2. The invention of claim 1, said means for releasably securing said primary top panel and said secondary top panel in perpendicular relation to one another when folded comprising:

each said opposing tray support flap of said primary top panel defining a generally V-shaped slot proximate an intersection of said side and rear edges of said primary top panel; and each said locking flap of said secondary top panel terminating in a locking tab defining a first notch proximate an end of said locking tab;

wherein a pair of said generally V-shaped slot and said locking tab are adapted for releasably engaging one another.

3. The invention of claim 2, said means for releasably securing said secondary top panel with said auxiliary top panel so as to cover the container when folded comprising:

each said base side panel defining an L-shaped slot proximate an edge of said base side panel closest and parallel to said front edge of said base panel;

wherein said locking tab and said L-shaped slot are adapted for releasably engaging one another.

4. The invention of claim 1, wherein said locking flaps are foldably joined to said secondary top panel along a pair of parallel fold lines.

5. The invention of claim 1, wherein said tray support flaps are foldably joined to said primary top panel along a pair of parallel fold lines.

6. The invention of claim 1, wherein said canopy support flaps are foldably joined to said auxiliary top panel along a parallel pair of fold lines.

7. The invention of claim 1, wherein each said base side panel defines a generally D-shaped handle panel foldably connected to said base side panel proximate and parallel to said first exterior edge of said base side panel.

8. The invention of claim 7, wherein each said rear side panel defines a first generally D-shaped slot proximate and parallel to said second exterior edge thereof corresponding to and positioned for alignment with said generally D-shaped handle formed in a respective said base side panel and each said front side panel defines a second generally D-shaped slot proximate and parallel to said third exterior edge thereof corresponding to and positioned for alignment with said generally D-shaped handle formed in a respective said base side panel.

9. A blank for forming a container for storing, transporting and displaying articles comprising:

a base panel having a front edge, a rear edge, and opposing side edges;

a pair of opposing base side panels each foldably joined to said base panel at a respective said opposing side edge of said base panel defining generally L-shaped slot proximate an edge of said base side panel closest and parallel to said front edge of said base panel and having a first exterior edge distal said opposing side edge of said base panel;

a pair of opposing retaining flaps each hingedly connected to a respective said base side panel proximate said first exterior edge of said base side panel by at least one web member defining a first notch in said first exterior edge of said base side panel and a second notch in an edge of said retaining flap adjacent said first exterior edge of said base side panel;

a rear panel foldably joined to said base panel at said rear edge of said base panel, having a bottom edge coincident with said rear edge of said base panel, a top edge, and opposing side edges;

a pair of opposing rear side panels each foldably joined to said rear panel at a respective said opposing side edge of said rear panel adjacent a respective said base side panel, having a top edge substantially collinear with said top edge of said rear panel, a bottom edge substantially collinear with said bottom edge of said rear panel, a second exterior edge distal a respective said side edge of said rear panel and a configuration corresponding to a configuration of said base side panel, and defining at least one third notch in said top edge of said rear side panel corresponding to said first notch in said first exterior edge of said base side panel; wherein a first distance between said top edge of said rear panel and said bottom edge of said rear panel is generally equal to a second distance between said first exterior edge of said base side panel and said side edge of said base panel; and wherein said bottom edge of said rear side panel and said top edge of said rear side panel correspond respectively to said side edge of said base panel and said first exterior edge of said base side panel;

a primary top panel foldably joined to said rear panel at said top edge of said rear panel, having a rear edge coincident with said top edge of said rear panel, a front edge, and opposing side edges;

a pair of opposing tray support flaps foldably joined to said primary top panel at respective said side edges thereof along a parallel pair of fold lines, having a terminal edge distal said side edge of said primary top panel and defining a generally V-shaped slot proximate the intersection of said side and rear edges of said primary top panel;

a secondary top panel foldably joined to said primary top panel at said front edge of said primary top panel, having a rear edge coincident with said front edge of said primary top panel, a front edge, and opposing side edges;

a pair of locking flaps foldably joined to said secondary top panel at respective said side edges thereof along a parallel pair of fold lines, each said locking flap terminating in a locking tab defining a fourth notch proximate an end of said locking tab;

a front panel foldably joined to said base panel at said front edge of said base panel, having a bottom edge coincident with said front edge of said base panel, a top edge, and opposing side edges;

a pair of opposing front side panels each foldably joined to said front panel at a respective said opposing side edge of said front panel adjacent a respective said base side panel, having a top edge substantially collinear with said top edge of said front panel, a bottom edge substantially collinear with said bottom edge of said front panel, a third exterior edge distal said side edge of said front panel and having a configuration corresponding to a configuration of said respective said base side panel, and defining at least one fifth notch in said top edge thereof corresponding to said first notch in said first exterior edge of said base side panel;

wherein a third distance between said top edge of said front panel and said bottom edge thereof is generally equal to said second distance between said first exterior edge of said base side panel and said side edge of said base panel;

wherein said bottom edge of said front side panel and said top edge of said front side panel correspond respectively to said side edge of said base panel and said first exterior edge of said base side panel; and an auxiliary top panel foldably joined to said front panel at said top edge of said front panel, having a front edge coincident with said top edge of said front panel, a rear edge, opposing side edges, and a pair of opposing canopy support flaps foldably joined to said auxiliary top panel at respective said side edges thereof along a parallel pair of fold lines; and wherein said generally V-shaped slot and said locking tab are adapted for releasably engaging one another.

10. The invention of claim 9, wherein a fourth distance between said opposing side edges of said rear panel and a fifth distance between said opposing side edges of said front panel are substantially equal and slightly less than a sixth distance between said opposing side edges of aid base panel.

11. The invention of claim 9, said at least one web member comprising a pair of web members in spaced relationship to one another.

12. The invention of claim 9, wherein each said base side panel defines a generally D-shaped handle panel foldably connected to said base side panel proximate and parallel to said first exterior edge of said base side panel.

13. The invention of claim 12, wherein each said rear side panel defines a first generally D-shaped slot proximate and parallel to said second exterior edge thereof corresponding to and positioned for alignment with said generally D-shaped handle formed in a respective said base side panel and each said front side panel defines a second generally D-shaped slot proximate and parallel to said third exterior edge thereof corresponding to and positioned for alignment with said generally D-shaped handle formed in a respective said base side panel.

14. The invention of claim 9, further comprising means for releasably engaging said auxiliary top panel and said opposing tray support flaps when said opposing tray support flaps and said opposing locking flaps are joined to form a tray for the container and said auxiliary top panel is positioned over said tray as a canopy.

15. The invention of claim 14, said means for releasably engaging said auxiliary top panel and said opposing tray support flaps when said opposing tray support flaps and said opposing locking flaps are joined to form a tray for the container and said auxiliary top panel is positioned over said tray as a canopy comprising:

each said opposing tray support flap defining a sixth notch in said terminal edge of said tray support flap; and said auxiliary top panel defining a seventh notch in said rear edge thereof proximate said opposing side edges thereof; and wherein said sixth notch and said seventh notch are adapted for releasably engaging one another when said opposing tray support flaps and said opposing locking flaps are joined to form a tray for the container and said auxiliary top panel is positioned over said tray as a canopy.

16. The invention of claim 9, wherein said base panel, said front panel and said rear panel define at least one first aperture aligned along said front and rear edges of said base panel, said base panel and said base side panels define at least one second aperture along said side edge of said base panel, said rear side panels al d said front side panels respectively define at least one third aperture along said bottom edge thereof corresponding to a portion of said at least one second aperture defined along said side edge of said base panel which extends into respective said base side panel, said rear panel and said primary top panel define at least one fourth aperture along said top edge of said rear panel, said front panel and said auxiliary top panel define a least one fifth aperture along said top edge of said front panel, said top edge of said secondary top panel defines at least one eighth notch corresponding to said at least one fifth aperture defined along said top edge of said front panel, said rear panel defines at least one sixth aperture mediate said bottom edge, said top edge and said opposing side edges thereof, and said front panel defines at least one seventh aperture mediate said bottom edge, said top edge and said opposing side edges thereof.

17. A blank for forming a container for storing, transporting and displaying articles comprising:

a base panel having a front edge, a rear edge, and opposing side edges;

a pair of opposing base side panels each foldably joined to said base panel at a respective said opposing side edge of said base panel defining a generally L-shaped slot proximate an edge of said base side panel closest and parallel to said front edge of said base panel, defining a generally D-shaped handle panel foldably connected to said base side panel proximate and parallel to said first exterior edge of said base side panel and having a first exterior edge distal said opposing side edge of said base panel;

a pair of opposing retaining flaps each hingedly connected to a respective said base side panel proximate said first exterior edge of said base side panel by a pair of web members in spaced relationship to one another defining respective first notches in said first exterior edge of said base side panel and second notches in an edge of said retaining flap adjacent said first exterior edge of said base side panel;

a rear panel foldably joined to said base panel at said rear edge of said base panel, having a bottom edge coincident with said rear edge of said base panel, a top edge, and opposing side edges;

a pair of opposing rear side panels each foldably joined to said rear panel at a respective said opposing side edge of said rear panel adjacent a respective said base side panel, having a top edge substantially collinear with said top edge of said rear panel, a bottom edge substantially collinear with said bottom edge of said rear panel, a second exterior edge distal a respective said side edge of said rear panel and a configuration corresponding to a configuration of said base side panel, and defining third notches in said top edge of said rear side panel corresponding to said first notches in said first exterior edge of said base side panel and a first generally D-shaped slot proximate and parallel to said second exterior edge of said base side panel corresponding to and positioned for alignment with said generally D-shaped handle formed in said base side panel;

wherein a first distance between said top edge of said rear panel and said bottom edge thereof is generally equal to a second distance between said first exterior edge of said base side panel and said side edge of said base panel; and wherein said bottom edge of said rear side panel and said top edge of said rear side panel correspond respectively to said side edge of said base panel and said first exterior edge of said base side panel; and a primary top panel foldably joined to said rear panel at said top edge of said rear panel, having a rear edge coincident with said top edge of said rear panel, a front edge, and opposing side edges;

a pair of opposing tray support flaps each foldably joined to said primary top panel at respective side edges thereof along a parallel pair of fold lines, having a terminal edge distal said side edge of said primary top panel and defining a generally V-shaped slot proximate the intersection of said side and rear edges of said primary top panel and defining a fourth notch in said terminal edge;

a secondary top panel foldably joined to said primary top panel at said front edge of said primary top panel, having a rear edge coincident with said front edge of said primary top panel, a front edge, and opposing side edges;

a pair of locking flaps foldably joined to said secondary top panel at respective said side edges thereof along a pair of parallel fold lines, each said locking flap terminating in a locking tab defining a fifth notch proximate an end of said locking tab;

a front panel foldably joined to said base panel at said front edge of said base panel, having a bottom edge coincident with said front edge of said base panel, a top edge, and opposing side edges;

a pair of opposing front side panels each foldably joined to said front panel at a respective said opposing side edge of said front panel adjacent a respective said base side panel, having a top edge substantially collinear with said top edge of said front panel, a bottom edge substantially collinear with said bottom edge of said front panel, a third exterior edge distal said side edge of said front panel and a having configuration corresponding to a configuration of said base side panel, and defining sixth notches in said top edge of said front side panel corresponding to said first notches in said first exterior edge of said base side panel and defining a second generally D-shaped slot proximate and parallel to said third exterior edge of said base side panel corresponding to and positioned for alignment with said generally D-shaped handle formed in a respective said base side panel;

wherein a third distance between said top edge of said front panel and said bottom edge thereof is generally equal to said second distance between said first exterior edge of said base side panel and said side edge of said base panel; and wherein said bottom edge of said front side panel and said top edge of said front side panel correspond respectively to said side edge of said base panel and said first exterior edge of said base side panel; and an auxiliary top panel foldably joined to said front panel at said top edge of said front panel, having a front edge coincident with said top edge of said front panel, a rear edge, opposing side edges, and a pair of opposing canopy support flaps foldably joined to said auxiliary top panel at respective side edges thereof along a parallel pair of fold lines, and defining a seventh notch in said rear edge of said auxiliary top panel proximate said opposing side edges thereof;

wherein a fourth distance between said opposing side edges of said rear panel and a fifth distance between said opposing side edges of said front panel are substantially equal and slightly less than a sixth distance between said opposing side edges of said base panel; and wherein said generally V-shaped slot and said locking tab are adapted for releasably engaging one another; and wherein said base panel, said front panel and said rear panel define at least one first aperture aligned along said front and rear edges of said base panel, said base panel and said base side panels define at least one second aperture along said side edge of said base panel, said rear side panels and said front side panels respectively define at least one third aperture along said bottom edge thereof corresponding to a portion of said at least one second aperture defined along said side edge of said base panel which extends into respective said base side panel, said rear panel and said primary top panel define at least one fourth aperture along said top edge of said rear panel, said front panel and said auxiliary top panel define at least one fifth aperture along said top edge of said front panel, said top edge of said secondary top panel defines at least one seventh notch corresponding to said at least one fifth aperture defined along said top edge of said front panel, said rear panel defines at least one sixth aperture mediate said bottom edge, said top edge and said opposing side edges thereof, and said front panel defines at least one seventh aperture mediate said bottom edge, said top edge and said opposing side edges thereof; and wherein said fourth notch and said seventh notch are adapted for releasably engaging one another when said opposing tray support flaps and said opposing locking flaps are joined to form a tray for the container when erected and said auxiliary top panel is positioned over said tray as a canopy.

18. A container formed from a blank for storing, transporting and displaying articles comprising:

a base panel having a front edge, a rear edge, and opposing side edges;

a rear panel foldably joined to said base panel at said rear edge of said base panel, having a bottom edge coincident with said rear edge of said base panel, a top edge, and opposing side edges;

a front panel foldably joined to said base panel at said front edge of said base panel, having a bottom edge coincident with said front edge of said base panel, a top edge, and opposing side edges;

opposing side wall panel structures foldably joined with said base panel, said rear panel and said front panel, each said side wall panel structure having a top edge;

whereby said top edge of said rear panel, said top edge of said front panel, and said top edges of said opposing side wall panel structures form a perimeter of an opening into the container;

a primary top panel foldably joined to said rear panel at said top edge of said rear panel, having a rear edge coincident with said top edge of said rear panel, a front edge, and opposing side edges;

a pair of opposing tray support flaps foldably joined to said primary top panel at respective said side edges thereof;

a secondary top panel foldably joined to said primary top panel at said front edge of said primary top panel, having a rear edge coincident with said front edge of said primary top panel, a front edge, and opposing side edges;

a pair of locking flaps foldably joined to said secondary top panel at respective said side edges thereof;

an auxiliary top panel foldably joined to said front panel at said top edge of said front panel, having a front edge coincident with said top edge of said front panel, a rear edge, and opposing side edges;

a pair of opposing canopy support flaps foldably joined to said auxiliary top panel at respective said side edges thereof;

means for releasably securing said primary top panel and said secondary top panel in perpendicular relation to one another when folded; and means for releasably securing said secondary top panel with said auxiliary top panel so as to cover said opening into the container.

19. The invention of claim 18, said means for releasably securing said primary top panel and said secondary top panel in perpendicular relation to one another when folded comprising:

each said opposing tray support flap of said primary top panel defining a generally V-shaped slot proximate an intersection of said side and rear edges of said primary top panel; and each said locking flap of said secondary top panel terminating in a locking tab defining a first notch proximate an end of said locking tab;

wherein a pair of said generally V-shaped slot and said locking tab are adapted for releasably engaging one another.

20. The invention of claim 19, said means for releasably securing said secondary top panel with said auxiliary top panel so as to cover the container when folded comprising:

each said side wall panel structure defining a generally L-shaped slot proximate an edge of said side wall panel structure closest and parallel to said front edge of said base panel;

wherein said locking tab and said generally L-shaped slot are adapted for releasably engaging one another.

21. The invention of claim 18, wherein said locking flaps are foldably joined to said secondary top panel along a pair of parallel fold lines.

22. The invention of claim 18, wherein said tray support flaps are foldably joined to said primary op panel along a pair of parallel fold lines.

23. The invention of claim 19, wherein said canopy support flaps are foldably joined to said auxiliary top panel along a parallel pair of fold lines.

24. The invention of claim 19, wherein each said side wall panel structure defines a generally D-shaped handle slot therethrough.

25. The invention of claim 19, wherein said side wall panel structures comprise in respective flat-faced relationship to one another a pair of opposing base side panels each foldably joined to said base panel at a respective said opposing side edge of said base panel, having a first exterior edge distal said side edge of said base panel;

a pair of opposing rear side panels each foldably joined to said rear panel at a respective said opposing side edge of said rear panel adjacent a respective said base side panel, having a top edge substantially collinear with said top edge of said rear panel, a bottom edge substantially collinear with said bottom edge of said rear panel, a second exterior edge distal a respective said side edge of said rear panel and a configuration corresponding to a configuration of said base side panel; and a pair of opposing front side panels each foldably joined to said front panel at a respective said opposing side edge of said front panel adjacent a respective said base side panel, having a top edge substantially collinear with said top edge of said front panel, a bottom edge substantially collinear with said bottom edge of said front panel, a third exterior edge distal said side edge of said front panel, and a having configuration corresponding to a configuration of said respective said base side panel.

26. The invention of claim 25, wherein generally D-shaped handle slots are respectively defined in alignment through said opposing base side panels, said rear side panels and front side panels.

* * * * *